US010330307B2

(12) United States Patent
Knaust et al.

(10) Patent No.: US 10,330,307 B2
(45) Date of Patent: Jun. 25, 2019

(54) PRINTING SYSTEM AND METHOD FOR PRINTING SUBSTRATES

(71) Applicant: WIHA WERKZEUGE GmbH, Schonach (DE)

(72) Inventors: Holger Knaust, Neuenburg am Rhein (DE); Stefan Haringer, Winden (DE); Andreas Beh, Waldkirch (DE)

(73) Assignee: WIHA WERKZEUGE GMBH, Schonach (DE)

( * ) Notice: Subject to any disclaimer, the term of this patent is extended or adjusted under 35 U.S.C. 154(b) by 159 days.

(21) Appl. No.: 15/072,425

(22) Filed: Mar. 17, 2016

(65) Prior Publication Data

US 2016/0271772 A1 Sep. 22, 2016

(30) Foreign Application Priority Data

Mar. 20, 2015 (DE) ..... 10 2015 205 122

(51) Int. Cl.

| | |
|---|---|
| ***F21V 33/00*** | (2006.01) |
| ***B25B 15/00*** | (2006.01) |
| ***B25B 21/00*** | (2006.01) |
| ***B25B 23/18*** | (2006.01) |

(52) U.S. Cl.

CPC ..... *F21V 33/0084* (2013.01); *B25B 15/00* (2013.01); *B25B 21/00* (2013.01); *B25B 23/18* (2013.01)

(58) Field of Classification Search

CPC ..... F21V 33/0084

See application file for complete search history.

(56) References Cited

U.S. PATENT DOCUMENTS

| | | | | |
|---|---|---|---|---|
| 2,468,193 | A * | 4/1949 | Goff | F16D 43/20 192/56.2 |
| 2,948,792 | A * | 8/1960 | Elliott et al. | H01H 25/065 200/11 C |
| 3,329,185 | A * | 7/1967 | Hettich | B25B 21/00 173/217 |
| 4,448,098 | A | 5/1984 | Totsu | |
| 2011/0090673 | A1* | 4/2011 | Shih | B25B 23/18 362/119 |

FOREIGN PATENT DOCUMENTS

| | | | |
|---|---|---|---|
| CH | 533497 | A | 2/1973 |
| DE | 19963237 | A1 | 6/2001 |
| DE | 102010018581 | A1 | 10/2011 |

* cited by examiner

*Primary Examiner* — Sharon E Payne
(74) *Attorney, Agent, or Firm* — Stephen T. Olson; Harness, Dickey & Pierce, P.L.C.

(57) ABSTRACT

A screwdriver includes a handle having a longitudinal axis. At the one end of the handle, the screwdriver includes a bit holder extending in the direction of the longitudinal axis or a screwdriver blade extending in the direction of the longitudinal axis. The screwdriver is further includes a drive mechanism in the handle. The drive mechanism causes a bit holder in the handle or the screwdriver blade opposite the handle to rotate. The drive mechanism includes a motor and a freewheel through which the motor can be coupled to the bit holder or the screwdriver blade. The freewheel is designed to relieve the torque when manual torque is introduced into the bit holder or the screwdriver blade through the handle. The drive mechanism further includes a torque limiter for limiting the drive torque of the motor on the bit holder or the blade.

17 Claims, 2 Drawing Sheets

PRINTING SYSTEM AND METHOD FOR PRINTING SUBSTRATES

CROSS-REFERENCE TO RELATED APPLICATIONS

This application claims the benefit and priority of German Application No. 10 2015 205 122.6 filed 20 Mar. 2015. The entire disclosure of the above application is incorporated herein by reference.

FIELD

The invention relates to a screwdriver.

BACKGROUND

Screwdrivers are well-known. They function to tighten or loosen screws. The screws are typically provided with a head that includes an engagement contour that a bit or a screwdriver blade engages. Other screws without a head are also well-known that include an engagement contour at one end and are identified as set screws. These known screwdrivers are characterized in that the screws are tightened or also loosened by means of manual torque that is introduced through a handle of the screwdriver. What is possible, in particular, when tightening these screws is to apply the torque with considerable sensitivity. This is critical, in particular, for screws having a small diameter of ≤1.6 mm. It is thus easily possible to avoid unintentionally shearing off the screw. Electrically operated screwdrivers are also well-known. They function to facilitate tightening or loosening screws. Driven screwdrivers are frequently equipped with a torque limiter that serves to limit the torque applied to a screw to a desired value. It has been found that these screwdrivers cannot be adjusted with sufficient sensitivity. On the other hand, conventional screwdrivers that are employed manually are disadvantageous when used for a large number of screwed connections because the use thereof is tiring and time-consuming.

SUMMARY

The object of the invention is therefore to provide a screwdriver that both enables screws to be tightened and loosened quickly and without fatigue, but at the same time also allows for a very sensitive working procedure.

In order to achieve this object, a screwdriver is provided that comprises the features referenced in claim 1. The screwdriver according to the invention includes a handle extending along the longitudinal axis thereof, which handle functions to securely hold the screwdriver and to introduce torque into the screwdriver. A bit holder is provided at one end of the handle, the bit holder extending in the direction of the longitudinal axis, or a screwdriver blade is provided extending in this longitudinal axis, whereby the term screwdriver blade mentioned here is a conventional blade of a screwdriver that engages a slot of a screw, for example. This term also comprises blades for Phillips screws, socket head screws, Torx screws, or the like—and finally also such screws that by means of a multi-sided edge grasp a corresponding complementarily shaped screw head or a nut so as to enable torque to be applied. The screwdriver is characterized in comprising a drive mechanism in the handle, by means of which the bit holder or screwdriver blade can be made to rotate relative to the handle, thereby enabling torque to be applied to a screw or, as explained above, to a nut, in order either to tighten or loosen these. The drive mechanism includes a motor that can generally be driven electrically, as well as a freewheel through which the motor can be coupled to the bit holder or the screwdriver blade. The freewheel is designed here to decouple the motor from the bit holder or the screwdriver blade whenever manual torque is applied to the bit holder or the screwdriver blade. Finally, the screwdriver is characterized in that the drive mechanism includes a torque limiter by which the output torque that is acting on the screw to be tightened or loosened can be limited to a desired value that is less than the shearing torque of the screw. Once the desired maximum torque has been reached, the motor stops without building up any further increased torque. The motor of the drive mechanism enables a screw to be tightened until the maximum torque is reached that has been set by the torque limiter. The screw in this phase is screwed tight quickly without any manual actuation, including grasping, and without fatiguing the user. The motor stops once the maximum torque is reached. The user can now continue to turn the screwdriver manually and very sensitively apply to the screw a torque that exceeds the torque set by the torque limiter. The bit holder or the screwdriver blade are decoupled from the motor by the freewheel when manual torque is applied, thereby preventing the motor from being negatively affected as the screwdriver continues to be operated. The screwdriver can be used especially preferably for screws, in particular, those having a thread of ≤2.5 mm, in particular, ≤1.6 mm. The final manual sensitive tightening of the screws prevents the screws from being sheared off.

A preferred embodiment of the screwdriver is characterized in that the freewheel has a double action whereby the above-described advantages can be utilized not only when a screw is tightened but also when it is loosened. In the event a screw or nut is stuck in place due to contamination or rust, the torque applied by the motor can be limited to a value below the shear-off torque, thereby allowing a user to apply loosening torque to the screw or nut manually with high sensitivity and to avoid any unintentional shearing off.

Another embodiment of the screwdriver is characterized in that the drive mechanism includes a gear unit that enables a screw being tightened or loosened to rotate faster than for manual tightening.

An embodiment of the screwdriver is preferably characterized by a switching ring of a switching device by which the motor of the drive mechanism of the screwdriver can be actuated, preferably with clockwise or counterclockwise rotation.

BEST DESCRIPTION OF THE DRAWINGS

The following discussion describes the invention in more detail based on the drawing. Here:

DETAILED DESCRIPTION

Figure 1:
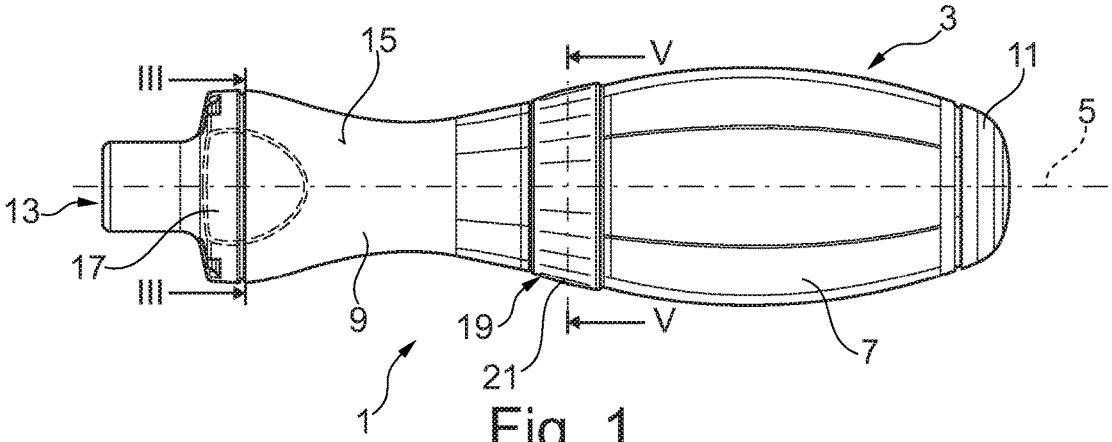
FIG. 1 is a side view of a screwdriver according to the invention.

FIG. 1 is side view of a screwdriver 1. The screwdriver includes a handle 3 extending in the direction of a longitudinal axis 5. Handle 5 of the embodiment shown here includes an essentially barrel-shaped convex force rotation zone 7 having a first outer diameter, as well as a so-called twirl zone 9 adjoining on the left and a smooth terminal section 11 to the right of force rotation zone 7, which section easily slides within the hand of a user when pressure is applied, thereby avoiding an excessively high mechanical load on the inner surface of the hand.

A section comprising a bit holder 13, this section being rotationally supported relative to handle 3, adjoins twirl zone 9 of handle 3 on the left. It is possible here to provide also directly on handle 3 a section comprising a screwdriver blade of the type referenced above, which section is designed to rotate relative to the handle, the blade extending in the direction of longitudinal axis 5. Bit holder 13 is disposed coaxially relative to longitudinal axis 5.

A flat section 17 is provided in the outer surface 15 of handle 3 here in the left region of twirl zone 9, this flat section acting as roll-off protection, that is, preventing screwdriver 1 from rolling on a slightly oblique surface and falling on the floor.

Either all or parts of outer surface of handle 3 can also be provided with especially slip-proof materials, thereby allowing the handle to rest especially well within the hand and enabling a relatively high torque to be transferred. In particular, commercially available handle 3 of screwdriver 1 can also be employed in connection with screwdriver 1 described here. Finally, handle 3 preferably has an overall ergonomic design so as to allow working with screwdriver 1 of the type described here in a way that is fatigue-free and reduces effort.

The outer contour described here of handle 3 is ultimately of no significance for the invention. The critical aspect here is that screwdriver 1 includes a more or less cylindrical handle 3 of longitudinal axis 5, and a section disposed coaxially and offset therefrom that can rotate relative to handle 3, that is, effect a relative rotation, wherein the rotational axis of the relative rotation coincides with longitudinal axis 5. This rotational section includes bit holder 13 or is provided directly with a screwdriver blade.

Handle 3 is provided with a switching device 19, by means of which a drive mechanism effecting the relative rotation of the left section of screwdriver 1 is actuated. In terms of a switching device, what is typically used in connection with motor-driven screwing devices are push-button switches, toggle switches, rocker switches, slide switches, or the like. Switching device 19 depicted here of screwdriver 1 preferably includes a switching ring 21, where the term switching ring 21 also identifies a ring segment that extends only over a limited circumferential region of handle 3. In order to provide ease of operation for switching device 19, switching ring 21 preferably extends over a further circumferential region of handle 3, thereby allowing the handle to be operated, in other words moved in a circumferential direction, by a user to as many rotational positions of screwdriver 1 as possible. The term circumferential direction here refers here to a direction that preferably runs essentially coaxially relative to longitudinal axis 5.

Figure 2:
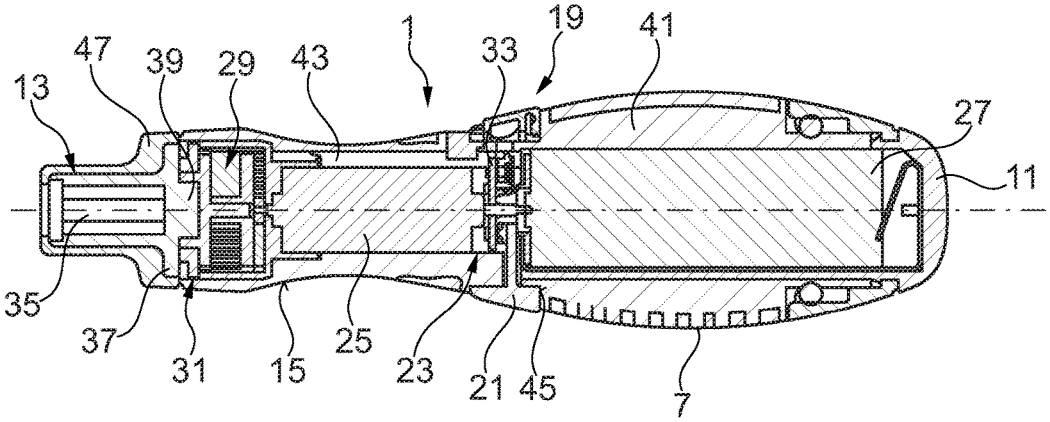
FIG. 2 is a longitudinal section through the screwdriver in FIG. 1.

FIG. 2 provides a longitudinal section of screwdriver 1 in FIG. 1, where the sectional plane is oriented such that longitudinal axis 5 lies within this plane. Identical or functionally equivalent elements are provided with the same reference characters, and with this in mind reference is made to the preceding description.

This illustration of screwdriver 1 reveals that a drive mechanism 23 is disposed inside handle 3. This mechanism comprises a motor 25 that is preferably provided here in the form of an electric motor and is supplied with electrical power by an energy storage means 27. A cord connection between motor 25 and an energy source is in principle also possible. However, the embodiment shown here is preferred, which is characterized by energy storage means 27 that is integrated in screwdriver 1, preferably in handle 3, the energy storage means being implemented, in particular, as a rechargeable battery. Obviously replaceable batteries can also be used instead. In addition, provision is made, in particular, whereby the battery can be replaced as necessary.

Motor 25 can be supplied selectively with power from energy storage means 27. To this end a switching device is provided that supplies motor 25 with power as required and that is also preferably designed to provide clockwise or counterclockwise operation of the motor, and thus clockwise or counterclockwise operation of a bit inserted in bit holder 13, or of a screwdriver blade.

Terminal section 11 of handle 3 is implemented in the form of a removable cap enabling energy storage means 27 to be replaced. Motor 25 acts here on bit holder 13 through gear unit 29 and, in particular, a freewheel 31. Although freewheel 31 is absolutely required in screwdriver 1 described here, gear unit 29 can be eliminated—particularly in the event corresponding control means are provided for the rotational speed of motor 25.

Gear unit 29 depicted here is preferably provided in the form of a two-stage planetary gear unit. This unit is characterized by an especially compact constructive design, one that is short as viewed in the direction of longitudinal axis 5. It is furthermore possible to specify the gear ratio between the rotational speed of motor 25 and of bit holder 13 within a wide range.

Switching unit 19 includes additional components, as is evident in the sectional view. Seen here in particular is a component support unit provided as circuit board assembly 33 that is described below in more detail.

The sectional view of FIG. 2 also reveals that bit holder 13 includes receptacle section 35 for a bit, which section runs in the direction of longitudinal axis 5 and is disposed coaxially relative to this axis, a collar 37 running radially relative to longitudinal axis 5, as well as a stub shaft 39. The stub shaft—as viewed in the direction of longitudinal axis 5—is sufficiently short so as to engage only freewheel 31 and not gear unit 29. This provides a very short and compact constructive design.

The sectional view of FIG. 2 also shows that handle 3 includes a base body 41 that surrounds the interior space 43 of handle 3 in which drive mechanism 23 is accommodated, and that also accommodates switching ring 21 in an appropriate recess, here a circumferential groove 45. Groove 45 running circumferentially is sufficiently long so as to accommodate switching ring 21. If the ring is provided in the form of an annular segment, groove 45 can be correspondingly short—as viewed in the circumferential direction. Groove 45 must in any case be sufficiently long to enable the switching ring to mover therein. This allows a switching procedure to be effected. This is described in more detail below.

Bit holder 13 of screwdriver 1 is surrounded by a housing 47 so that bit holder 13 is held securely, an attractive external design for screwdriver 1 is provided, and furthermore bit holder 13 is covered.

Figure 3:
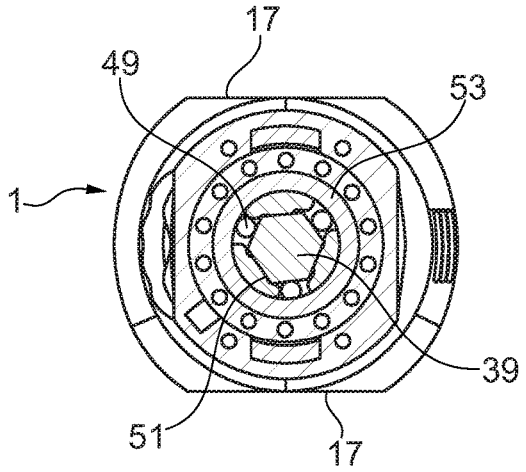
FIG. 3 is a cross section through the screwdriver in FIG. 1 along line III-III.

FIG. 3 is a cross section through screwdriver 1 along line III-III depicted in FIG. 1. Identical or functionally equivalent elements are provided with the same reference characters, and with this in mind reference is made to the preceding description.

The sectional plane chosen in FIG. 3 is oriented such that longitudinal axis 5 is perpendicular thereto.

Figure 4:
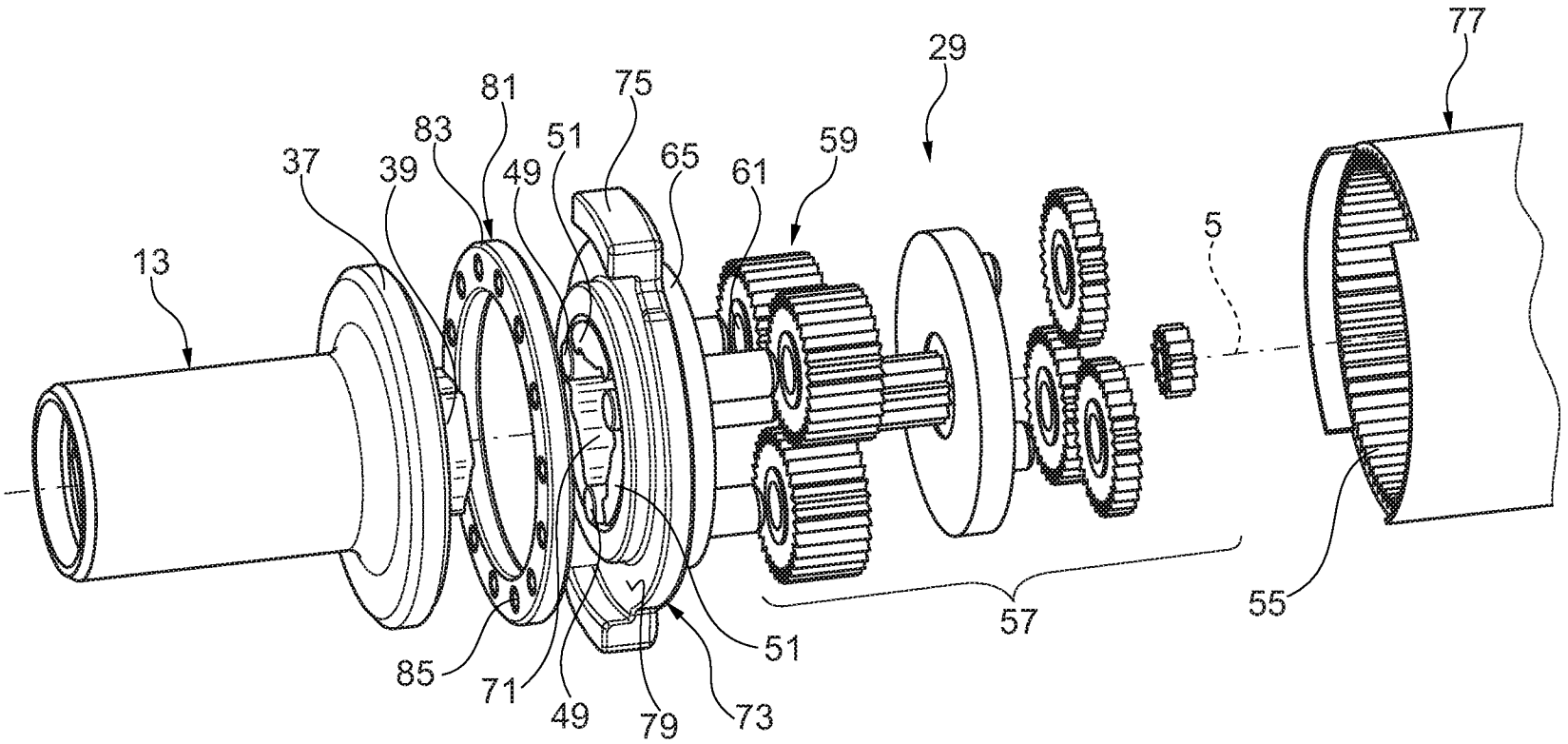
FIG. 4 is an exploded view of the screwdriver.

Screwdriver 1 is shown in FIG. 3. Flat sections 17 can be seen on the top and bottom that prevent screwdriver 1 from rolling away. FIG. 3 depicts stub shaft 39 of bit holder 13, the stub shaft extending into freewheel 31. The freewheel comprises a number rolling elements 49, here preferably three such bodies also identified as clamping rollers, that interact with a number of clamping jaws 51. Three clamping jaws 51 are provided here matching the number of rolling elements 49. Rolling elements 49 and clamping jaws 51 are disposed inside a closed ring 53 of freewheel 31. The inside dimensions of ring 53 are selected so that rolling elements 49 and clamping jaws 51 are disposed within an annular section between the inside surface of ring 53 and the outside of stub shaft 39. Clamping jaws 51 are provided in the broadest sense as annular segments, for which the size as measured circumferentially is selected so that in each case a free space remains between clamping jaws 51, which are disposed an equal distance apart as viewed circumferentially, in which space rolling elements 49 are disposed. Clamping jaws 51 are attached to an annular body, which is not visible here but is depicted in FIG. 4, which body is disposed coaxially relative to longitudinal axis 5 and is made to rotate by motor 25 when motor 25 has been supplied with power. When the annular body rotates, clamping jaws 51 revolve around a circular path about the longitudinal axis 5. Three rolling elements 49 are disposed axially parallel to longitudinal axis 5 of screwdriver 1 and are driven by clamping jaws 51 so that they also revolve around a circular path about the longitudinal axis. Clamping jaws 51 interact with the outer surface of stub shaft 39 such that torque from motor 25 is transferred through clamping jaws 51 to stub shaft 39 when clamping jaws 51 rotate. The rotation of the annular body, which is effected by motor 25, in other words acts through clamping jaws 51 causing stub shaft 39 and thus also bit holder 13 to rotate. The maximum predetermined torque can be achieved which may be applied by motor 25 to bit holder 13, and thus also to the screw, both when tightening a screw and also loosening a stuck screw. Motor 25 in this case stops without applying increased torque to bit holder 13.

In the event a screw must now be further tightened or loosened manually by screwdriver 1 after reaching the maximum torque to be applied by the motor, handle 3 is made to rotate very sensitively by the user and is acted upon by a manually applied torque.

When handle 3 turns, the lock ring 73 that is also connected in a rotationally fixed manner to the handle is also made to rotate. As a result, rolling element 49 is clamped into a tapered gap between the inner surface of lock ring 73 and the outer surface of stub shaft 39, with the result that in this working phase manual torque acts on stub shaft 39 and thus on bit holder 13 so that a bit accommodated here causes a screw to rotate. When handle 3 is turned manually, lock ring 73, but also gear unit 29, which is supported in a rotationally fixed manner in handle 3, is made to rotate by motor 25.

In response to a rotation of motor 25 and a rotation of annular body 65, which is effected by preferably provided gear unit 29, clamping jaws 51 rotate and effect a rotation of stub shaft 39 of bit holder 13. The design of freewheel 31 allows torque in this operating mode to be applied to the drive side, that is, bit holder 13 exclusively through motor 25, gear unit 29, annular body 65, and clamping jaws 51.

When motor 25 stops once the maximum specified torque has been reached at which a screw has not yet been sheared off, it is possible as described above to manually apply torque to bit holder 13 by continuing to manually turn handle 3 and thus also lock ring 73. In this mode of freewheel 31, torque is applied exclusively through handle 3, lock ring 73, and rolling elements 49 that are clamped between inner surface of lock ring 73 and outer surface of stub shaft 39. The fact that clamping ring 73 in this operating mode is moved synchronously together with gear unit 29 and motor 25 creates torque relief, that is, the torque that is applied manually and introduced into handle 3 is not transferred back through freewheel 31 into gear unit 29, and/or motor 25. This torque relief during application of manual torque to bit holder 13 ensures that no portion of the manual torque is passed back into gear unit 29 and/or motor 25 during the application of manual torque to bit holder 13 when a screw is tightened or loosened manually. As a result, these two elements of screwdriver 1 are protected from being damaged.

Stub shaft 39 of bit holder 13 can thus ultimately be acted upon by torque applied by motor 25, with the result that depending on the rotational direction of motor 25 bit holder 13 rotates about longitudinal axis 5 to the right to tighten a screw or to the left to loosen a screw.

When manual torque is applied by means of a rotational movement of handle 3, the torque is transferred to stub shaft 39 of bit holder 13, which then turns in the intended direction.

There are thus two ways—by motor and manually—that torques can act on stub shaft 39 and produce a rotation of the bit holder. Freewheel 31 ensures that no damage occurs in drive mechanism 23 when manual torque is introduced into handle 3 due to the torque relief for gear unit 29 and motor 25.

Drive mechanism 23, as explained above, is equipped with a torque limiter, with the result that rotation of clamping jaws 51 effected by motor 25 is stopped as soon as a predeterminable output torque is applied to stub shaft 39. The limitation of torque is implemented by the design of drive mechanism 23. The maximum output torque for the motor drive is selected so that a screw being tightened by screwdriver 1 cannot shear off. It should be noted that the maximum output torque is also selected so as to prevent a screw from shearing off when being unscrewed.

Freewheel 31 is ultimately selected so as to enable torque to be applied by screwdriver 1 manually through freewheel 31 to bit holder 13 or to a screwdriver blade provided here whenever rotation of rolling elements 49 and stub shaft 39 produced by motor 25 is stopped once the maximum predetermined output torque has been reached. Freewheel 31 in this operating mode provides torque relief so that torque applied manually to handle 3 of screwdriver 1 does not damage motor 25 and optionally provided gear unit 29. A screw can be screwed in or loosened further with great sensitivity in this operating mode.

What is evident overall is that drive mechanism 23 makes it possible for a screw to be inserted quickly without being surroundingly gripped by screwdriver 1, while allowing only a predetermined maximum output torque to act on the screw; this torque is less than the torque that would result in damage, in particular, a shear-off torque to the screw. Once the maximum set output torque has been reached, stub shaft 39 is not made to rotate further by motor 25. Additional torque can, however, be transferred manually by means of handle 3 of screwdriver 1 through freewheel 31 to a screw, thereby enabling the screw to be inserted or loosened with great sensitivity.

FIG. 4 is an exploded view of the front—at the left in FIGS. 1 and 2—section of screwdriver 1. Identical or functionally equivalent elements are provided with the same reference characters, and with this in mind reference is made to the preceding description.

The front-most end section of housing 77 is seen on the right-hand side of FIG. 4, which housing is disposed in a rotationally fixed manner in handle 3 of screwdriver 1, not shown here, and surrounds gear unit 29. A toothed gear structure 55 comprising teeth running parallel to longitudinal axis 5 is provided on the inside of housing 77, these teeth being engaged by toothed gears of gear unit 29, which toothed gears include an external toothing.

Screwdriver 1 depicted in FIG. 4 thus relates to an embodiment that is provided with gear unit 29.

The parts of gear unit 29, here preferably designed as a two-stage planetary gear unit 57, are seen in the exploded view to the left of twirl zone 9. Planetary gear unit 57—on the output side or the left in FIG. 4—includes three toothed gears 59 that are made to rotate by motor 25 provided in handle 3 and are moved along a circular path located coaxially relative to longitudinal axis 5. Pins 63 engage a central opening 61 of toothed gears 59. FIG. 4 shows that gear unit 29 provided in the form of planetary gear unit 57 includes three toothed gears 59 that constitute the planet gears of the second stage of second stage of planetary gear unit 57. Three toothed gears 59 are provided here, each of which includes a central opening 61. Three pins 63 are correspondingly provided that engage these openings 61. Pins 63 are attached to an annular body 65 that rotates about longitudinal axis 5 whenever pins 63 are made to rotate so as to rotate together with toothed gears 59 along a circular path running concentrically relative to longitudinal axis 5.

Three clamping jaws 51 are installed on annular body 65 in a rotationally fixed manner on the side opposite pins 63, which clamping jaws are disposed—as viewed circumferentially relative to center axis 5—equidistant from each other, as are pins 63, in other words here with an angular spacing of 120°. Annular body 65 and clamping jaws 51 can preferably also be provided as one integrated piece.

Respective rolling elements 49, which are disposed so as to rotate freely in freewheel 31, are disposed between clamping jaws 51, while motor 25 causes bit holder 13 to rotate. Three rolling elements 49 and three clamping jaws 51 are provided in the embodiment shown here.

Rolling elements 49 and clamping jaws 51, which are located on an imaginary circular path that is disposed concentrically relative to longitudinal axis 5, describe a free space 71 that stub shaft 39 of bit holder 13 engages.

Annular body 65 rests against lock ring 73 that is supported in a rotationally fixed manner in handle 3 and includes at least one retaining arm 75, here two opposing retaining arms 75 that run essentially radially relative to longitudinal axis 5. These arms are fixed within screwdriver 1.

A bearing device 81 is provided between the collar 37 of bit holder 13, which collar runs radially relative to longitudinal axis 5, and a contact surface 79 of lock ring 73, this surface facing toward bit holder 13, which bearing device enables bit holder 13 to rotate with low friction relative to lock ring 73 that is fixed within handle 3 and thus within screwdriver 1. An annular bearing is provided here that comprises a ball cage 83 in which a number of bearing elements is provided—preferably equidistant as viewed in the circumferential direction of longitudinal axis 5—these elements here being in the form of balls.

The housing 47 over bit holder 13 has in fact been omitted in FIG. 4 so as to more easily reveal the elements shown here.

Figure 5:
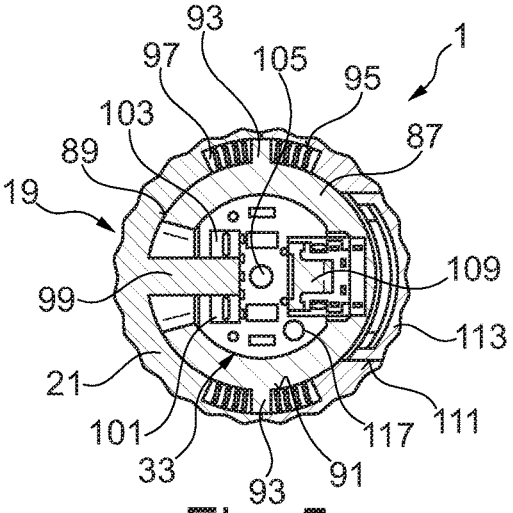
FIG. 5 is a cross section through the screwdriver in FIG. 1 along line V-V.

FIG. 5 provides a cross section through screwdriver 1 shown in FIGS. 1 and 2 along line V-V in FIG. 1. The sectional plane is selected here such that longitudinal axis 5 is oriented perpendicular to this plane. Identical or functionally equivalent elements are provided with the same reference characters, and with this in mind reference is made to the preceding description.

FIG. 5 depicts switching device 19, here including switching ring 21, which device is disposed concentrically relative to longitudinal axis 5 seen in FIGS. 1 and 2, and is supported enabling it to rotate on handle 3 of screwdriver 1. A partial section 87 of base body 41 of handle 3 is seen in FIG. 5, which section—as viewed in cross section—is essentially circular and includes an outer surface 89 with an outer diameter that is designed so that outer surface 89 contacts the inner surface 91 of switching ring 21 such that switching ring 21 is guided so as to slide along partial section 87 of base body 41.

Partial section 87 includes two opposing projections 93 that engage an annular-segment-shaped cutout 95 in inner surface 91 of switching ring 21. The illustration in FIG. 5 reveals two opposing projections 93. It is possible also to provide only one such projection or also more than two. One elastic element 97 each, in the form of helical springs in the embodiment depicted here, is provided in cutout 95 to the right and left of projection 93, which element is supported on the essentially radial inside of cutout 95.

Switching ring 21 can be rotated on partial section 87 clockwise or counterclockwise against the force of elastic elements 97 that are disposed under initial tension between the side walls of cutout 95 and the side walls of at least one projection 93. When switching ring 21 is turned counterclockwise, the elastic elements turn the ring back to the initial position shown in FIG. 5, with the result that external torque is no longer applied to the ring. The same is true when the switching ring is turned in the opposite rotational direction.

Switching ring 21 includes a switching arm 99 that projects over an inner surface 91 of the ring in the direction of longitudinal axis 5, which arm is rotationally fixed to switching ring 21 and is moved together with the ring whenever there is rotational motion thereof. Whenever switching ring 21 rotates counterclockwise in FIG. 5, switching arm 99 interacts with a first switching element 101. Switching device 19 in the embodiment shown here is designed so that a second switching element 103 is actuated whenever switching ring 12 in FIG. 5 rotates clockwise. Switching device 19 in the embodiment shown here is thus designed to actuate first switching element 101 or second switching element 102 depending on the rotational movement of switching ring 21. This enables bit holder 13 to rotate in one direction, for example clockwise, or in the opposite direction, for example counterclockwise, depending on the rotational movement of switching ring 21. A screw can thus be tightened or loosened by means of bit holder 13 depending on how switching ring 21 is actuated. In corresponding fashion, a screwdriver blade provided instead of bit holder 13 can be made to rotate clockwise or counterclockwise.

It is also possible in principle to design switching elements 101 and 103 to effect fast or slow rotation of the bit holder or of the screwdriver blade as a function of the relative position of switching arm 99 relative to switching elements 101, 103.

Switching elements 101 and 103 are part of circuit board assembly 33 that was also referenced in connection with the explanatory comments relating to FIG. 2. Aside from switching elements 101 and 103, this circuit board can also include other components, such as, for example, contacts 105 and 107 through which motor 25 can be connected to energy storage means 27.

Energy storage means 27 is preferably designed as a battery. This can be replaceable and/or rechargeable. In the embodiment shown here, a contact unit 109 is provided on circuit board assembly 33, preferably in the form of a USB connector, through which contact unit energy storage means 27 can be charged.

Provision is preferably made whereby switching ring 21 in this embodiment includes a cutout 111 that is covered by a protective cap 113. The cap is held captively within switching ring 21 but can be removed to allow access to contact unit 109 for charging energy storage means 27.

Circuit board assembly 33 can be equipped with a charge status display that can be seen through an inserted optical conductor, or through a translucent or clear viewing window that is provided there. In addition, a light source can be provided on circuit board assembly 33, the light source illuminating the working space of screwdriver 1 through appropriate optical conductors. However, it is also possible to connect a light source to circuit board assembly 33, the light source being disposed and oriented in housing 47, for example, so as to illuminate the working space of screwdriver 1.

The invention claimed is:

1. A screwdriver comprising:

a handle including a longitudinal axis, one of a bit holder or a screwdriver blade at a first end of the handle and extending in a direction of the longitudinal axis;

a drive mechanism in the handle, the drive mechanism causing a bit holder in the handle or the screwdriver blade opposite the handle to rotate, which drive mechanism includes a motor and a freewheel through which the motor is coupled to the bit holder or the screwdriver blade, the freewheel designed to relieve torque when manual torque is introduced into the bit holder or the screwdriver blade through the handle, wherein the drive mechanism includes a torque limiter for limiting drive torque of the motor on the bit holder or the screwdriver blade, wherein the drive mechanism includes a switching device for switching the motor on and off, the switching device includes a switching ring rotatable by a manually introduced torque, the switching ring connected to the motor such that the motor is actuated upon rotation of the switching ring, wherein the motor is selectively rotatable about the longitudinal axis in a clockwise direction and a counterclockwise direction in response to rotational movement of the switching ring in a first direction and in a second direction, respectively.

2. The screwdriver according to claim 1, wherein the freewheel is operative in opposite rotational directions.

3. The screwdriver according to claim 1, wherein the freewheel is designed as a clamping roller freewheel.

4. The screwdriver according to claim 1, wherein the drive mechanism includes a gear unit and/or an energy storage means.

5. The screwdriver according to claim 1, wherein the switching ring can be pushed into an initial position thereof by at least one elastic element whenever no external torque is acting on the switching ring.

6. The screwdriver according to claim 1, wherein the handle is ergonomically designed.

7. The screwdriver according to claim 1, further comprising a work area illumination means.

8. The screwdriver according to claim 1, wherein the switching ring includes a switching arm that projects over an inner surface of the switching ring in a direction of the longitudinal axis, which arm is rotationally fixed to switching ring and is moved together with the ring whenever there is rotational motion thereof.

9. The screwdriver according to claim 8, wherein the switching arm interacts with a first switching element in response to counterclockwise rotation of the switching ring and a second switching element in response to clockwise rotation of the switching ring.

10. The screwdriver according to claim 8, wherein the switching arm extends radially with respect to the switching ring.

11. The screwdriver according to claim 9, wherein the first and second switching elements cooperate to effect both fast and slow rotation of the bit holder or the screwdriver blade in response to a position of the switching arm relative to the first and second switching elements.

12. The screwdriver according to claim 1, wherein the screwdriver extends along the longitudinal axis from a proximal end to a distal end, the handle includes a handle portion at the proximal end, the motor is longitudinally disposed between the handle portion and the drive mechanism, and the switching ring is adjacent to the handle portion.

13. The screwdriver according to claim 1, wherein the handle includes a central handle portion housing the motor and a proximal handle portion, and the switching ring is longitudinally disposed between the proximal and central handle portions.

14. A screwdriver comprising:

a handle portion at a proximal end of the screwdriver;

a driven member selected from a group consisting of a bit holder and a screwdriver blade at a distal end of the screwdriver;

a motor operatively coupled to the driven member, the motor rotatable in a clockwise direction to drive the driven member in a corresponding clockwise direction and a counterclockwise direction to drive the driven member in a corresponding counterclockwise direction; and a switching device including a switching ring extending at least partially around a longitudinal axis of the screwdriver in a circumferential direction, wherein the motor is selectively rotatable about the longitudinal axis in the clockwise direction and the counterclockwise direction in response to rotational movement of the switching ring in a first direction and in a second direction, respectively.

15. The screwdriver according to claim 14, wherein the motor is longitudinally disposed between the handle portion at the proximal end of the screwdriver and the driven member.

16. The screwdriver according to claim 15, wherein the switching ring is adjacent the handle portion at the proximal end of the screwdriver.

17. The screwdriver according to claim 16, wherein the switching ring has a frustoconical shape.

* * * * *